US010941932B1

(12) United States Patent
Kallamthottathil et al.

(10) Patent No.: US 10,941,932 B1
(45) Date of Patent: Mar. 9, 2021

(54) WATER-RESISTANT EXTRUDED HOUSING FOR EMERGENCY LIGHTING COMPONENT

(71) Applicant: ABL IP Holding LLC, Atlanta, GA (US)

(72) Inventors: Dileep Kumar Kallamthottathil, Snellville, GA (US); Gunjan P. Patel, Alpharetta, GA (US); Paul W. Lewis, Jr., Grantville, GA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 16/876,375

(22) Filed: May 18, 2020

(51) Int. Cl.

| | |
|---|---|
| ***F21V 31/00*** | (2006.01) |
| ***F21V 23/00*** | (2015.01) |
| ***F21V 31/03*** | (2006.01) |
| ***F21S 9/02*** | (2006.01) |

(52) U.S. Cl.
CPC ..... *F21V 31/005* (2013.01); *F21S 9/024* (2013.01); *F21V 23/008* (2013.01); *F21V 31/03* (2013.01)

(58) Field of Classification Search
CPC ..... F21V 31/005; F21V 23/008; F21V 31/03; F21V 23/007; F21V 15/01; F21V 15/012; F21V 15/013; F21V 15/015; F21S 9/024; F21S 9/022
See application file for complete search history.

(56) References Cited

U.S. PATENT DOCUMENTS

| | | | | |
|---|---|---|---|---|
| 6,577,136 | B1 * | 6/2003 | Marques | G01R 31/40 315/86 |
| 9,976,735 | B2 | 5/2018 | Honda et al. | |
| D865,258 | S | 10/2019 | Honda et al. | |
| 10,794,580 | B1 * | 10/2020 | Su | F21V 31/005 |
| 2006/0215403 | A1 * | 9/2006 | Martineau | G09F 19/22 362/240 |
| 2016/0219729 | A1 | 7/2016 | Omari et al. | |
| 2016/0305643 | A1 | 10/2016 | Duckworth et al. | |

* cited by examiner

*Primary Examiner* — Bao Q Truong
(74) *Attorney, Agent, or Firm* — Kilpatrick Townsend & Stockton LLP

(57) ABSTRACT

A housing and an endcap may provide a water-resistant enclosure for an emergency lighting component. An upper side of the housing may include a curved surface extending above a vertical side of the housing. The vertical side may include an inclined surface and an extended edge that provide a first concave opening below the curved surface. A base side of the housing may include a curved surface extending partially below the vertical side. The vertical side may include an additional extended edge and a curved surface that provide a second concave opening where the vertical side joins the base side. The endcap may include a rim that overlaps a portion of the housing. The first or second concave openings may receive fasteners to attach the endcap. Mounting brackets may attach to the first or second concave openings, such as to attach the housing to a surface.

20 Claims, 9 Drawing Sheets

Emergency Lighting Component Housing 200

Emergency Lighting Component Housing 200

Endcap
300

Endcap
300

WATER-RESISTANT EXTRUDED HOUSING FOR EMERGENCY LIGHTING COMPONENT

TECHNICAL FIELD

This disclosure relates generally to the field of emergency lighting, and more specifically relates to enclosures of emergency lighting components.

BACKGROUND

Emergency lighting systems can be included in environments that are exposed to moisture or water. Environments with exposure to water, also called wet environments, can include outdoor lighting, parking garages, manufacturing facilities, food preparation facilities, or other environments where water (or other liquid) falls onto or is splashed onto components of the emergency lighting systems. In some cases, a wet environment can include a location where liquid is directed towards the emergency lighting systems, such as water sprayed during a cleaning activity or other activity performed in the wet environment.

An emergency lighting system in a wet environment can include a luminaire that is sealed or otherwise arranged to exclude liquid. In some cases, a wet environment can require an emergency lighting system capable of providing emergency lighting with certain characteristics, such as for a particular duration of time or having a particular intensity of light. An emergency lighting system may include an additional component, such as a power supply, to fulfill the required emergency lighting characteristics. However, an additional component that is external to a sealed luminaire may be subject to failure, such as from being splashed by water outside of the sealed luminaire. In addition, connections between the sealed luminaire and the additional component, such as electrical connections, may introduce points at which water can intrude on the sealed luminaire.

SUMMARY

According to certain implementations, an emergency lighting system may include a housing for an emergency lighting component and an endcap that covers an end of the housing. The housing may define an internal cavity that is configured to receive the emergency lighting component. The housing may include a base side, a curved side that is opposite the base side, a first side between the base side and the curved side, and a second side between the base side and the curved side. The first side and the second side may each include an outer dorsal surface that is proximate to the curved side. The outer dorsal surface may include an inclined surface and an extended edge of the inclined surface. The inclined surface may incline towards the base side. The extended edge may include a curve that provides a first concave opening between the extended edge and the inclined surface. The first side and the second side may each include an outer ventral surface that is proximate to the base side. The outer ventral surface may include a curve that provides a second concave opening where the ventral surface joins the base side. In addition, the endcap may include a rim that extends around a perimeter of the endcap. The rim may fit around a portion of an outer surface of the housing when the endcap is attached to the end of the housing. A plurality of fasteners may attach the endcap to the housing. The fasteners may be received in one or more of the first concave openings and the second concave openings that are in the first side and the second side.

These illustrative implementations are mentioned not to limit or define the disclosure, but to provide examples to aid understanding thereof. Additional implementations are discussed in the Detailed Description, and further description is provided there.

BRIEF DESCRIPTION OF THE DRAWINGS

Features, implementations, and advantages of the present disclosure are better understood when the following Detailed Description is read with reference to the accompanying drawings, where.

DETAILED DESCRIPTION

Figure 1:
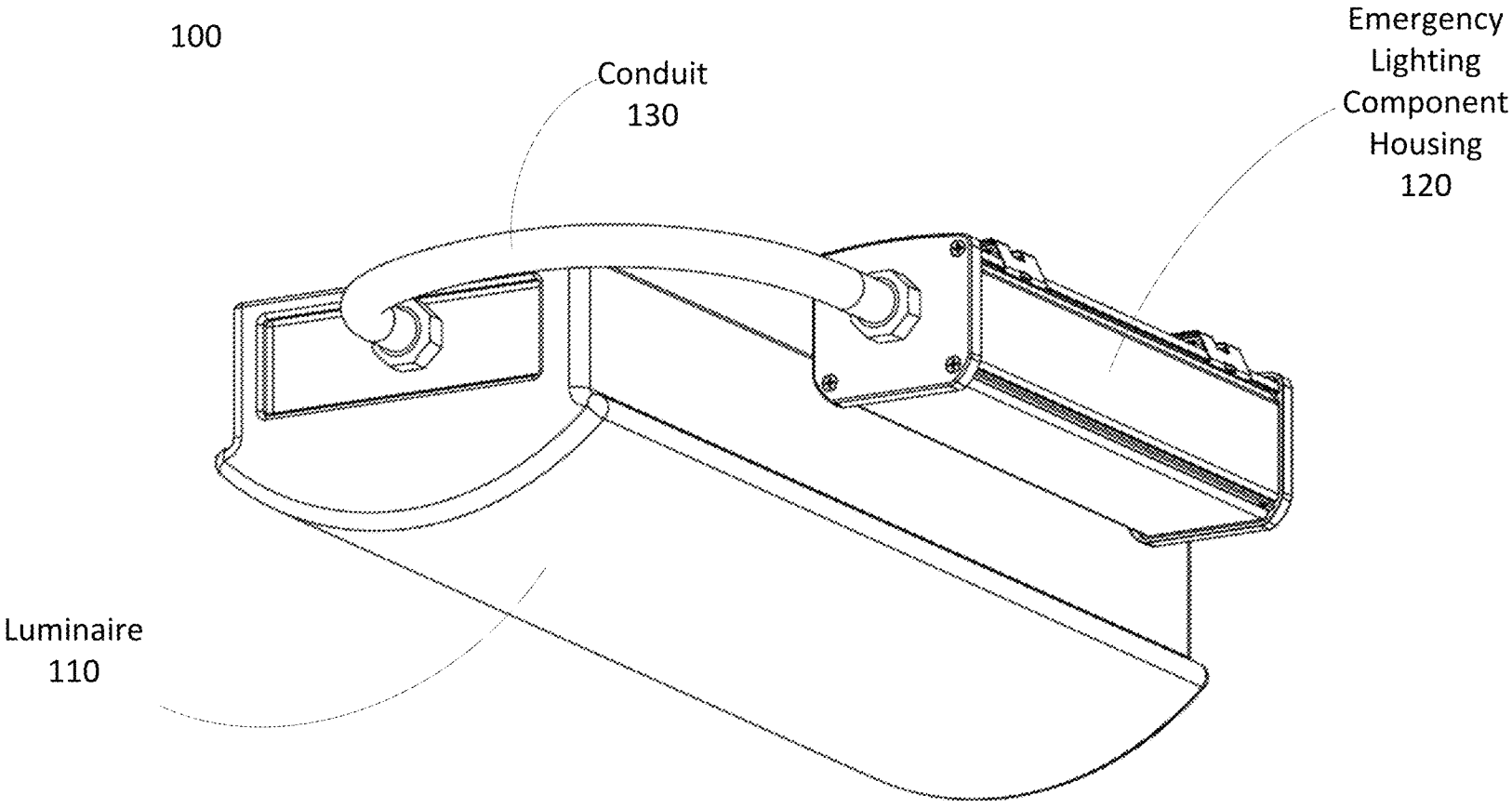
FIG. 1 is a diagram depicting an example of an emergency lighting system that may be installed in a wet environment, according to certain implementations.

As discussed above, an emergency lighting system may be used in a wet environment. The emergency lighting system may include one or more water-resistant emergency lighting components, such as water-resistant luminaires. However, a contemporary housing for a water-resistant component may be sized and shaped to enclose a particular type of component, such as a luminaire. The contemporary housing may be unable to protect a variety of emergency lighting components, such as due to size constraints of the contemporary housing. In addition, a water-resistant component in a contemporary housing may be unable to connect to additional components of the emergency lighting system. For example, a connection (e.g., an electrical connection) between contemporary housings may result in a loss of water resistance of the contemporary housings. The connected contemporary housings may be unable to protect the emergency lighting components from water that falls or splashes in the wet environment. In addition, a contemporary housing for a water-resistant component may not be able to provide access to features of the emergency lighting components, such as a test switch or pilot light. For example, the contemporary housing might be unable to provide access to a test switch while meeting requirements for a water-resistant rating or accessibility requirements.

Certain implementations described herein provide for an improved water-resistant housing for an emergency lighting component. The improved housing may attach to at least one improved endcap, to create a sealed or water-resistant internal cavity in which one or more emergency lighting components may be placed. Each of the housing and the endcap may include one or more water-resistant features that are capable of shedding or excluding water. In some cases, the water-resistant features are provided by portions of material out of which the housing or endcap is formed. In some cases, forming a water-resistant feature from the housing or endcap material may improve performance of the water-resistant feature, such as by eliminating seams between individual pieces of material. For example, an extrusion manufacturing process may form one or more of the water-resistant features of the housing. Formation of the water-resistant features via extrusion may improve performance of the housing, such as by providing a continuous surface over which water may flow. In addition, formation of the housing via extrusion may reduce manufacturing costs related to assembly of the housing. Further, formation of the housing via extrusion may provide housings of a wide variety of extruded lengths (e.g., about 3 cm to about 10 m), allowing a greater variety of emergency lighting components to be installed in wet environments. In some cases, an emergency lighting system that can include a variety of components may provide improved performance. For instance, an emergency lighting system that includes additional power supplies may provide extended lighting time or increased illumination. In addition, an emergency lighting system that includes communication modules may provide communication between luminaires or may integrate with additional systems, such as a security system or environmental control system.

In some implementations, a water-resistant conduit may be attached to one or more of the improved housing or the improved endcap, such that multiple emergency lighting components may be connected while enclosed in water-resistant housings. In some cases, an emergency lighting system that connects components enclosed in respective water-resistant housings may provide improved performance. For example, a water-resistant luminaire that is connected to one or more power supplies may provide extended lighting time or increased illumination.

As user herein, there terms "sealed" and "water-resistant" refer to an enclosure or a feature of an enclosure that provides protection from water or other liquid that is present on the enclosure or feature. A water-resistant enclosure or a water-resistant feature may be rated for a degree of protection against water or other liquid. In some cases, a water-resistant enclosure or a water-resistant feature may be rated for protection against falling liquid, splashed liquid, a directed stream of sprayed liquid, pressurized liquid (e.g., water pressure at a submerged depth), or other events that could introduce liquid on the feature or enclosure. As a non-limiting example, an enclosure may be rated according to International Electrotechnical Commission standard 60529, which describes degrees of protection provided by enclosures.

Referring now to the drawings, FIG. 1 is a diagram depicting an example of an emergency lighting system 100. The emergency lighting system 100 may include a luminaire 110, a housing 120 that can include an additional emergency lighting component, and a conduit 130. The emergency lighting system 100 can be included in a wet environment, such as a parking garage, a food preparation facility, an outdoor location, or any other location where the system 100 is exposed to water or other liquids. Although FIG. 1 depicts the emergency lighting system 100 as including the luminaire 110, other configurations are possible. For example, an emergency lighting system could include one or more housings connected by one or more conduits, such as additional emergency lighting components that are electrically connected via the conduits to an additional emergency lighting system, a control system (e.g., a building security system), or to another system that is capable of providing emergency lighting.

In some cases, the luminaire 110 can be a sealed luminaire, such as a luminaire that is included within a housing that is sealed (or mostly sealed) to reduce incursion of water inside the luminaire 110. The luminaire 110 can include one or more lighting components (e.g., LEDs, fluorescent bulbs, incandescent bulbs) that are capable of producing emergency lighting during an emergency mode. For example, the lighting components of the luminaire 110 could be configured to produce emergency lighting responsive to detecting a power outage. In some cases, the luminaire 110 may be configured to provide illumination during normal operations (e.g., a non-emergency mode). For instance, the luminaire 110 could be configured to provide, during normal operations, illumination that is powered via an AC power source (e.g., without receiving power from an emergency power supply).

In some implementations, the emergency lighting component housing 120 can be a sealed housing, such as a housing that is sealed (or mostly sealed) to reduce incursion of water into the housing 120. The housing 120 can have an internal cavity that is configured to receive one or more emergency lighting components. For example, the housing 120 could include one or more of an emergency power supply (e.g., a battery), a lighting control module (e.g., an LED driver), a communications module (e.g., a wireless transmitter, a Bluetooth transmitter, a low-voltage communications module), or another suitable component of an emergency lighting system.

In FIG. 1, the conduit 130 may provide a connection between the housing 120 and the luminaire 110. In some cases, the conduit 130 can be a sealed conduit, such as a conduit that is sealed (or mostly sealed) to reduce incursion of water inside the conduit 130 or one or more housings connected via the conduit 130. For example, the conduit 130 can include one or more fittings that are configured to create a water-resistant seal at a connection point with an additional component of the emergency lighting system 100, such as connection points with the luminaire 110 or the housing 120. In some cases, the conduit 130 is configured to receive one or more electrical conductors. In addition, the conduit 130 may be configured to provide an electrical connection, such as via the electrical conductors, between the luminaire 110 and an additional emergency lighting component included in the housing 120.

In some cases, one or more of the housing 120, conduit 130, or luminaire 110 can have a typical installation or a water-resistant installation. For instance, a typical installation of one or more of the housing 120 conduit 130, or luminaire 110 could include a particular location or orientation, such as an orientation with respect to gravity, or a location of the housing 120 with respect to the luminaire 110 (e.g., allowing airflow between components). In addition, a typical installation of the housing 120 can include a water-resistant orientation of the housing 120 The housing 120 can include one or more surfaces that are capable of reducing accumulation of water when configured according to the typical installation. For example, a dorsal side of the housing 120 (e.g., relative to a water-resistant orientation of the housing 120) can include one or more inclined surfaces, such that water on the exterior of the housing 120 would be likely to slide off the inclined surface. In addition, one or more external openings of the housing 120, such as areas for attachment of external mounting hardware, can have a downward orientation (e.g., relative to a water-resistant orientation of the housing 120), such that water would be unlikely to accumulate within the external openings. In some cases, the external mounting hardware may secure the housing 120 in a position with respect to the luminaire 110, such as above the luminaire 110 (e.g., to avoid blocking light emitted from the luminaire) or at a particular distance from the luminaire 110 (e.g., to allow airflow and evaporation between the housing and luminaire).

In FIG. 1, the emergency lighting system 100 is shown in a configuration suitable for a ceiling-mount installation. However, other configurations or installation types are possible. For example, one or more of the housing 120 or the conduit 130 may be included in emergency lighting systems having wall-mounted luminaires, suspension-mount luminaires, or other suitable types of luminaires. As a non-limiting example, the housing 120 could be connected to a wall-mounted luminaire via the conduit 130. In this non-limiting example, the housing 120 could be installed (e.g., mounted to the wall) according to the water-resistant orientation, and could be located above the wall-mounted luminaire.

Figure 2A:
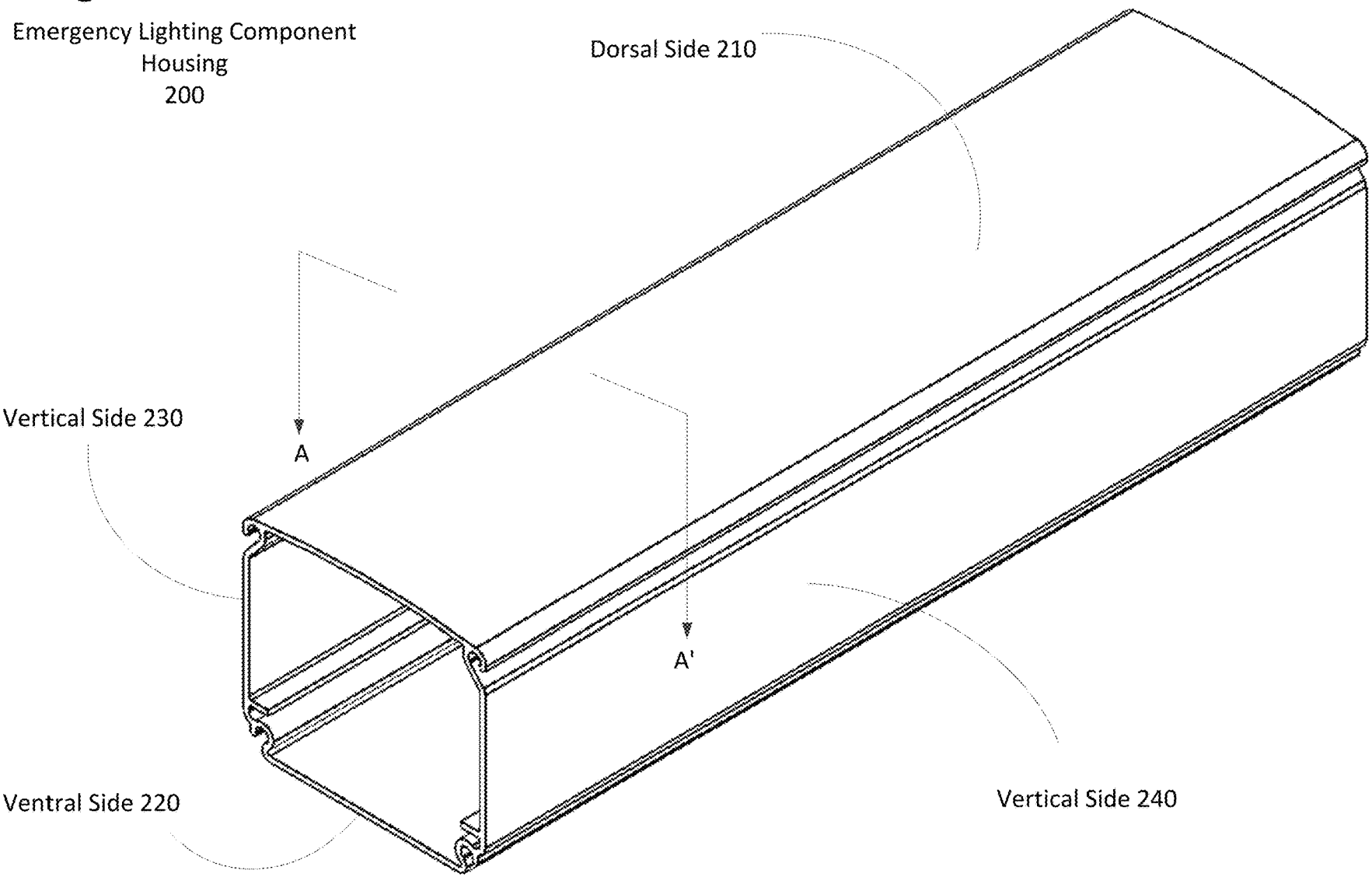
FIGS. 2A, 2B, and 2C (collectively referred to as FIG. 2) are views of an example housing for an emergency lighting component, according to certain implementations.
Figure 2B:
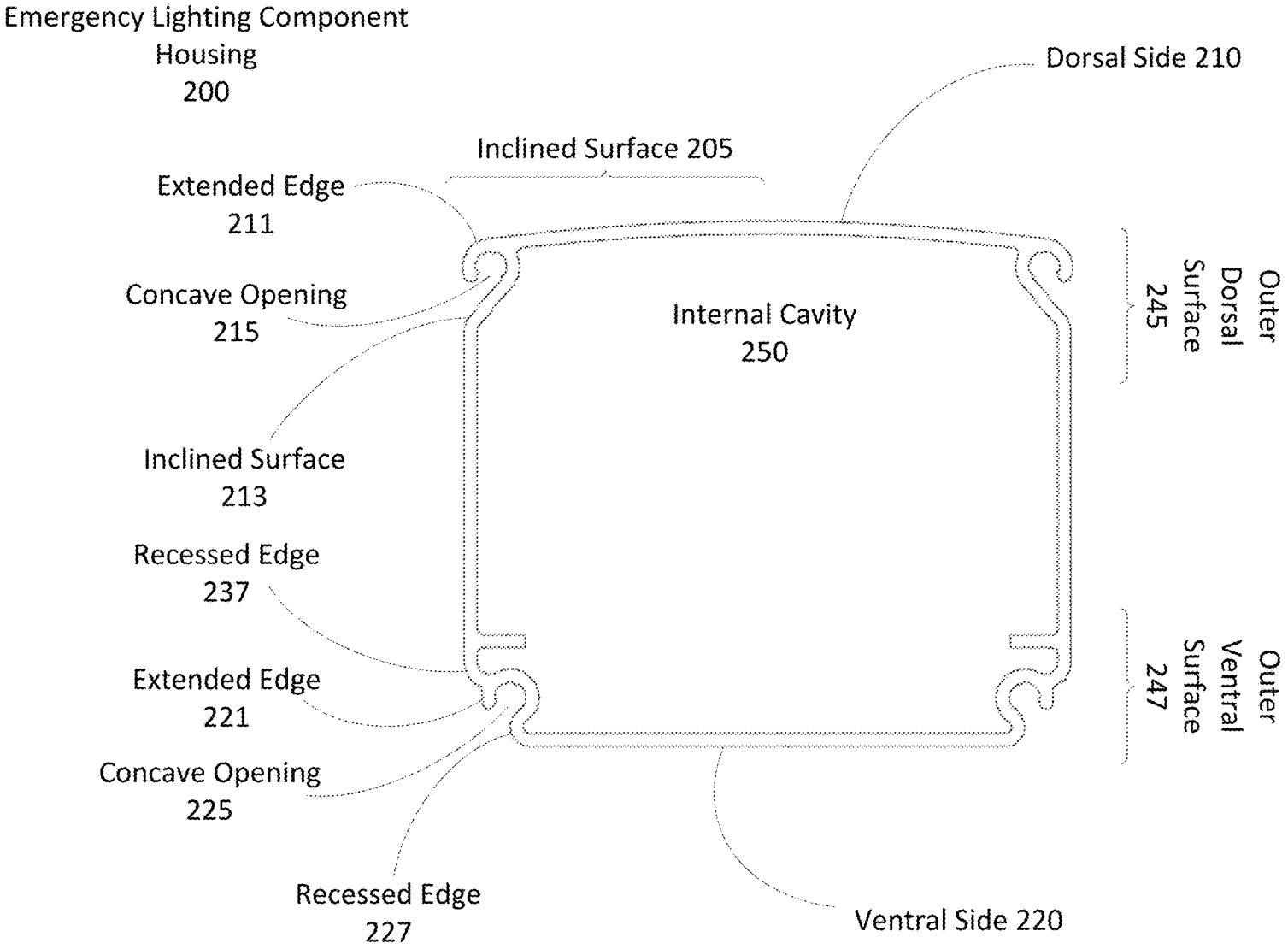
Figure 2C:
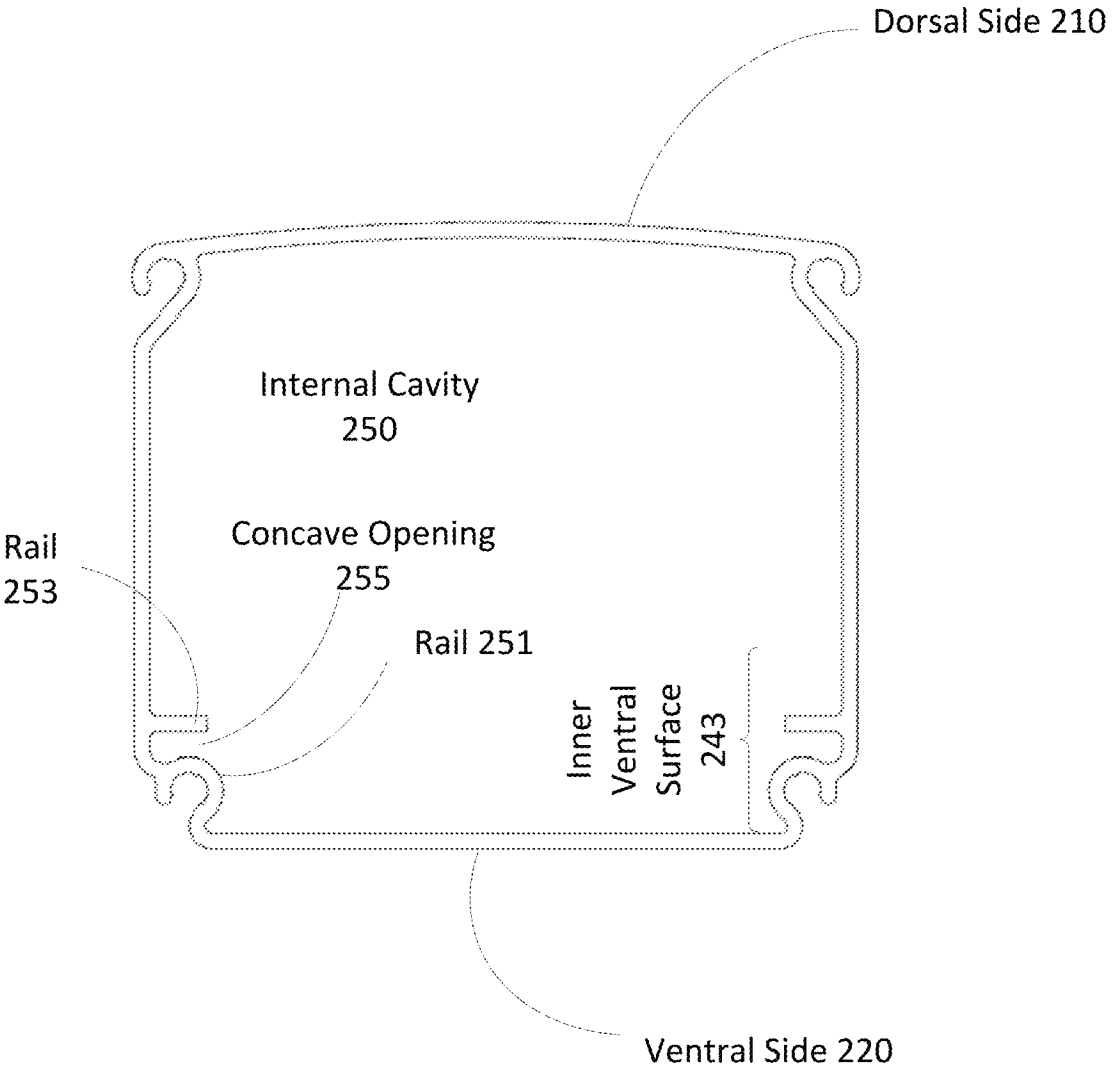

FIG. 2A is an isometric view of an example housing 200 for an emergency lighting component. FIG. 2B is a cross-sectional view of the example housing 200. FIG. 2B depicts a view at an example cut, such as a cut between points A and A' depicted in FIG. 2A, including depictions of some external features of the housing 200. FIG. 2C depicts the cross-sectional view of the example housing component 200, at the example cut between points A and A' depicted in FIG. 2A, including depictions of some internal features of the housing 200. FIGS. 2A, 2B, and 2C may be collectively referred to herein as FIG. 2. The housing 200 can be included in an emergency lighting system, such as described in regards to FIG. 1. In addition, the housing 200 can be configured to house an additional emergency lighting component, such as an emergency power supply or lighting driver. In some cases, the housing 200 may be formed by an extruded material, such as extruded aluminum or extruded plastic. The extruded material may be adjusted to any length that is suitable for a component of an emergency lighting system (e.g., about 5 cm to about 10 m).

In some implementations, the housing 200 can have a water-resistant orientation, such as described in regards to FIG. 1. In addition, the housing 200 can include one or more water-resistant features that are configured to shed water, prevent accumulation of water, seal an opening, or otherwise resist water incursion in the housing 200. In the configuration depicted in FIG. 2A, the housing 200 has a dorsal side 210, a ventral side 220, and at least one vertical side, such as a vertical side 230 and a vertical side 240. In FIG. 2, the top side 210 is depicted as curved, but this implementation is non-limiting, and other configurations are possible. For example, an emergency lighting component housing may have a dorsal side having one or more inclined surfaces, or having any other configuration capable of shedding or preventing accumulation of water. In FIG. 2, the sides 230 and 240 are described as vertical for convenience, not by way of limitation, and other configurations are possible. For example, an emergency lighting component housing may have a side that is substantially straight, substantially perpendicular to a top or bottom of the housing, inclined towards the top or bottom of the housing, curved or partially curved, or have any other configuration capable of shedding or preventing accumulation of water.

In the water-resistant orientation of the example housing 200, the dorsal side 210 may be arranged above the ventral side 220 (e.g., the dorsal surface is farther from the ground). In addition, the surfaces 210, 220, 230, and 240 may enclose an internal cavity of the housing 200, such as an internal cavity 250. In some cases, the internal cavity 250 may be encompassed by an internal surface of the material comprising the housing 200. In addition, the material comprising the housing 200 may include incursions or extrusions that form one or more water-resistant features of the housing 200.

In FIG. 2, the housing 200 is shown in the water-resistant configuration, such that the dorsal side 210 is shown as a top side, e.g., an upper side of the housing 200 with respect to the side surfaces 230 and 240 and the ventral side 220. In addition, in the water-resistant configuration, the ventral side 220 is shown as a base side, e.g., a lower side of the housing 200 with respect to the side surfaces 230 and 240 and the dorsal side 210. In FIG. 2, the ventral side 220 is depicted as flat for convenience, but other configurations are possible. For example, an emergency lighting component housing may have a ventral side that is curved or partially curved, inclined or partially inclined, or have any other configuration capable of shedding or preventing accumulation of water.

In FIG. 2B, the dorsal side 210 may include one or more inclined surfaces, such as an inclined surface 205. The inclined surface 205 may slope downwards from a relative high point of the dorsal side 210. In FIG. 2B, the inclined surface 205 is depicted as sloping downwards from a high point at or near the center of the dorsal side 210, but other configurations are possible (e.g., a relative high point away from the center of the dorsal side 210).

In some implementations, a side of the housing 200 may include one or more outer surfaces, such as an outer dorsal surface 245 or an outer ventral surface 247. In some cases, the outer dorsal surface 245 may be included in (or partially included in) one or more of the dorsal side 210 or the vertical sides 230 or 240. In addition, the outer ventral surface 247 may be included in (or partially included in one or more of the ventral side 220 or the vertical sides 230 or 240. The outer dorsal surface 245 may be located near the dorsal side 210 (e.g., near the top of the housing 200). In addition, the outer ventral surface 247 may be located near the ventral side 220 (e.g., near the bottom of the housing 200). In some implementations, the outer dorsal surface 245 may form a transition between the dorsal side 210 and a respective one of the vertical sides 230 or 240. In addition, the outer ventral surface 247 may form a transition between the ventral side 220 and a respective one of the vertical sides 230 or 240.

The outer dorsal surface 245 may include one or more extended edges, such as an extended edge 211. The extended edge 211 may be formed by an extrusion of the housing 200, such that the extended edge 211 extends outward above the vertical side 230 or 240. In addition, the extended edge 211 may have a curvature that extends downwards from the dorsal side 210. In some cases, the extended edge 211 may continue or increase a slope of the inclined surface 205. In addition, the extended edge 211 may form a drip point. For example, water that is shed by the inclined surface 205 may continue downwards along the extended edge 211 and be shed from the housing 200 at the drip point of the extended edge 211.

The outer dorsal surface 245 may include one or more inclined surfaces, such as an inclined surface 213. In some cases, the extended edge 211 may transition to the inclined surface 213. A first concave opening 215 may be defined by the extended edge 211 and the inclined surface 213. In some cases, the concave opening 215 includes surfaces that are oriented downwards or at a downwards slope, such that any water entering the concave opening 215 is shed by either the extended edge 211 or the inclined surface 213.

The outer ventral surface 247 may include one or more recessed edges, such as a recessed edge 237. In addition, the outer ventral surface 247 may include one or more extended edges, such as an extended edge 221. The extended edge 221 may be formed by an extrusion of the housing 200, such that the extended edge 221 extends downwards (e.g., below a side surface of the housing 200). In some cases, the recessed edge 237 forms an inclined surface that leads towards the extended edge 221. In addition, the extended edge 221 may form a drip point. For example, water that is shed by a respective one of the vertical sides 230 or 240 may continue downwards along the recessed edge 237 and be shed from the housing 200 at the drip point of the extended edge 221.

The outer ventral surface 247 may include one or more recessed edges, such as a recessed edge 227. The recessed edge 227 may be recessed with regards to the side surface of the housing 200. In addition, the recessed edge 227 may be formed by a curvature of the housing 200. In some cases, the extended edge 221 may transition to the recessed edge 227. A second concave opening 225 may be defined by the extended edge 221 and the recessed edge 227. In some cases, the concave opening 225 includes surfaces that are oriented downwards or at a downward slope, such that any water entering the concave opening 225 is shed by either the extended edge 221 or the recessed edge 227. In FIG. 2B, the recessed edge 227 is depicted as recessed with regards to the extended edge 221, but other configurations are possible, such as a lower edge of the concave opening 225 that extends flush with the extended edge 221 or beyond the extended edge 221.

In some implementations, one or more of the concave openings 215 or 225 are configured to receive a fastener, such as a clasp, screw, clamp, nail, or other suitable fastener. As a non-limiting example, the concave openings 215 or 225 could be threaded to receive a screw or other threaded fastener. For instance, the concave openings 215 or 225 could include one or more microprojections that are positioned to assist with insertion of a screw. A relatively small quantity of microprojections (e.g., about 3 microprojections) could be positioned around an interior surface of the concave openings to guide the fastener during insertion or assembly of the water-resistant configuration of the housing 200. In some cases, one or more of the concave openings 215 or 225 extend throughout a length of the housing 200. For example, a fastener could be inserted through a length of the concave opening 215 or 225, or multiple fasteners could be inserted at multiple ends of the concave openings 215 or 225.

FIG. 2C depicts the cross-sectional view of the example housing component 200, at the example cut between points A and A' depicted in FIG. 2A. In the housing 200, the internal cavity 250 can be configured to receive an emergency lighting component, such as a power supply or a lighting controller. In some cases, the internal cavity 250 may include one or more stabilizing features configured to receive a portion of the emergency lighting component, such as rails that are configured to receive a mounting bracket. In addition, the material comprising the housing 200 may include incursions or extrusions that form one or more stabilizing features of the housing 200.

In some implementations, a side of the housing 200 may include one or more inner surfaces, such as an inner ventral surface 243. In some cases, the inner ventral surface 243 may be included in (or partially included in) one or more of the ventral side 220 or the vertical sides 230 or 240. The inner ventral surface 243 may be located near the ventral side 220 (e.g., near the bottom of the housing 200). In some implementations, the inner ventral surface 243 may form a transition between the ventral side 220 and a respective one of the vertical sides 230 or 240.

The inner ventral surface 243 may include one or more rails, such as a first rail 251 or a second rail 253. The rails 251 or 253 may be formed by one or more respective incursions (e.g., from material of the housing 200) that extend inwards into the internal cavity 250. In some cases, the first rail 251 can be formed by a curvature of one or more water-resistant features of the housing 200. For example, the rail 251 may be formed by a curvature of material formed around one or more of the concave opening 225, the extended edge 221, or the recessed edge 227. In some cases, the second rail 253 can be formed by material extending into the internal cavity 250 from a respective one of the vertical sides 230 or 240. In some cases, one or more of the rails 251 or 253 may form a respective mounting rail that extends throughout a length of the housing 200. The example mounting rails may be configured to support or guide a bracket of the emergency lighting component.

In some implementations, a concave opening 255 may be defined by the rail 251 and the rail 253. In some cases, the concave opening 255 includes surfaces that are configured to receive a portion of the emergency lighting component that can be housed within the internal cavity 250. For example, the concave opening 255 may include lower and upper surfaces respectively formed by rails 251 and 253. As a non-limiting example, the lower and upper surfaces of the concave opening 255 may form a rail channel that extends throughout a length of the housing 200. The example rail channel may be configured to receive a bracket of the emergency lighting component. In some cases, a mounting rail, such as a mounting rail defined by one or more of the rails 251 or 253, may extend along at least a portion of a rail channel. A bracket of the emergency lighting component may be guided via the mounting rail into the rail channel, such as during an insertion of the emergency lighting component in the housing 200. In addition, the bracket of the emergency lighting component may be supported by the mounting rail within the rail channel, such as in an installation of the emergency lighting component and the housing 200. In some cases, the formation of the mounting rail or rail channels by material of the housing 200 provides a water-resistant feature of the housing 200. For example, the formed mounting rail or rail channels may hold the emergency lighting component in a particular position with respect to the housing 200 (e.g., a distance of about 0.5 cm to about 3 cm above a base side of the housing 200), such that the emergency lighting component is held above any water that might enter the housing 200. In addition, the formed mounting rail or rail channels may provide an easier installation of the emergency lighting component in the housing 200, such as by providing a stable mounting location for the bracket (e.g., without additional fasteners or other additional stabilizing hardware).

Figure 3A:
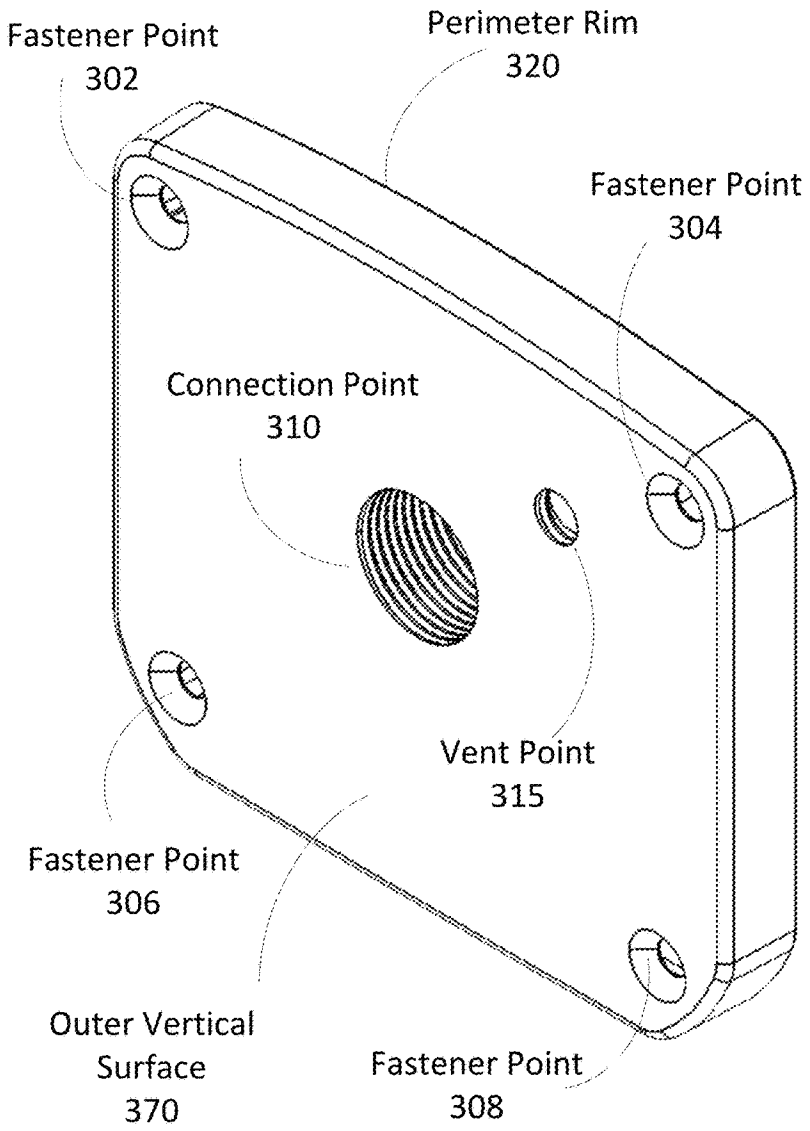
FIGS. 3A and 3B (collectively referred to as FIG. 3) are views of an example endcap for a housing of an emergency lighting component, according to certain implementations.
Figure 3B:
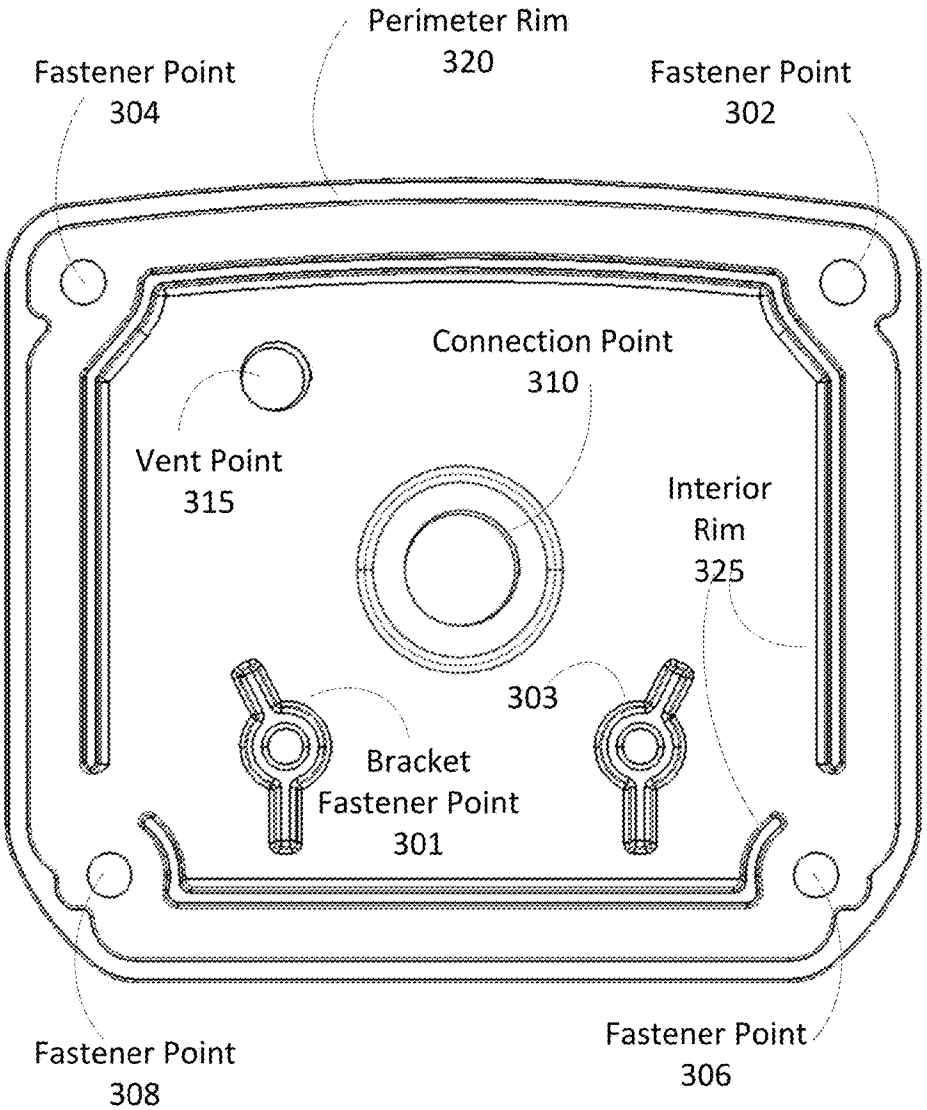

In some implementations, the housing 200 is configured to attach to one or more endcaps. For example, the internal cavity 250 may be enclosed by a first endcap that attaches to a first opening of the housing 200, and by a second endcap that attaches to a second opening of the housing 200. FIG. 3A is an isometric view of an example endcap 300, and shows a portion of an exterior surface of the endcap 300. FIG. 3B is a rear elevation view of the example endcap 300, and shows a portion of an interior surface of the endcap 300. FIGS. 3A and 3B may be collectively referred to herein as FIG. 3. For convenience, and not by way of limitation, the endcap 300 is described with regards to the example housing 200 described in regards to FIG. 2, but other configurations are possible.

In some implementations, the endcap 300 may have an orientation that is configured to match the water-resistant orientation of the housing 200. For example, the endcap 300 may have an outer dorsal surface that is configured to match a curvature or an inclined surface of the dorsal side 210. In addition, the endcap 300 may have a vertical (or substantially vertical) surface that is configured to shed water. For example, FIG. 3A depicts an outer vertical surface 370 that, when oriented according to the water-resistant orientation of the housing 200, may be substantially vertical and substantially perpendicular to the dorsal, ventral, and vertical sides 210, 220, 230, and 240.

The endcap 300 may have one or more fastener points, such as a fastener point 302, a fastener point 304, a fastener point 306, or a fastener point 308. In some cases, one or more of the fastener points 302, 304, 306, or 308 may be aligned with a respective concave opening of the housing 200, such as one or more of the concave openings 215 or 225. As a non-limiting example, the endcap 300 may be configured to attach to the housing 200 such that the fastener point 302 is aligned with the concave opening 215, and such that the fastener point 306 is aligned with the concave opening 225. In some cases, one or more of the fastener points 302, 304, 306, or 308 may be configured to receive a first type of fastener (e.g., a screw, a nail) that is configured to extend through the fastener point and extend into the aligned concave opening of the housing 200. In addition, one or more of the fastener points 302, 304, 306, or 308 may be configured to include a second type fastener (e.g., a clamp, a clip) that is configured to attach to the fastener point and connect to the aligned concave opening of the housing 200. In FIGS. 3A and 3B, the fastener points 302, 304, 306, and 308, are depicted as being configured to receive a screw, but other implementations are possible, including other types of fasteners not described herein.

In some implementations, the endcap 300 may include one or more connection points, such as a connection point 310. The connection point 310 may include an opening through which one or more electrical conductors (e.g., wires) may pass. The connection point 310 may be configured to receive a conduit, such as the conduit 130 described in regards to FIG. 1. In addition, the connection point 310 may be configured such that the electrical conductors may provide an electrical connection between the emergency lighting component within the housing 200 and an additional component of an emergency lighting system, such as the luminaire 110 described in regards to FIG. 1. In some cases, the connection point 310 may be configured to prevent water incursion through the point 300, such as incursion into the internal cavity 250. In addition, a water-resistant seal may be provided by an attachment of the conduit to the connection point 310. For example, one or more of the conduit or the connection point 310 may include one or more of a gasket, an oil-based sealant, a protective casing, or other suitable features to resist water incursion at the connection point 310. In some cases, the connection point 310 may be threaded, such as to receive a conduit with a screw-type connection, or otherwise configured to fasten to the conduit.

The endcap 300 may include a rim around an external perimeter of the endcap 300, such as a perimeter rim 320. In some implementations, the perimeter rim 320 is fitted to an outer surface of the housing 200. For example, the perimeter rim 320 may be configured to fit around outer surfaces of one or more of the dorsal, ventral, or vertical sides 210, 220, 230, or 240. In some cases, the perimeter rim 320 may provide an enclosure of the internal cavity 250. For example, the rim 320 may overlap at least a portion of the outer surface of the housing 200. In addition, the endcap 300 may include a rim around at least a portion of an interior area of the endcap 300, such as an interior rim 325. In some implementations, the inner rim 325 is fitted to an inner surface of the housing 200. For example, the interior rim 325 may be configured to fit within inner surfaces of one or more of the dorsal, ventral, or vertical sides 210, 220, 230, or 240. In some cases, the interior rim 325 may provide an enclosure of the internal cavity 250. For example, the rim 325 may overlap at least a portion of the inner surface of the housing 200.

In some implementations, one or more of the perimeter and interior rims 320 or 325 may provide a water-resistant feature. For example, a channel may be formed by an area between the rims 320 and 325. In some cases, a water-resistant seal may be provided by the overlap of the rims 320 or 325 with the outer and inner surfaces of the housing 200. In addition, the water-resistant seal may be provided by a material (e.g., a gasket, a sealant) that is included in the channel between the rims 320 and 325. In a water-resistant installation of the housing 200, the water-resistant seal may prevent or reduce water incursion into the internal cavity 250.

The example endcap 300 may include one or more fastener points on an interior surface of the endcap 300, such as a bracket fastener point 301 and a bracket fastener point 303. The bracket fastener points 301 and 303 may provide an attachment for a bracket of the emergency lighting component. In addition, the bracket fastener points 301 and 303 may be positioned on an interior area of the endcap 300, such as an area that is interior with respect to the interior rim 325. In some cases, the bracket fastener points 301 and 303 may position the bracket of the emergency lighting component within the housing 200, such as within the internal cavity 250. In FIG. 3, the bracket fastener points 301 and 303 are shown on an inner surface of the endcap 300, such as depicted in FIG. 3B, without puncturing or otherwise disrupting an outer surface of the endcap 300, such as depicted in FIG. 3A. In some cases, the interior formation of the bracket fastener points 301 and 303 (e.g., without disrupting an outer surface) provides improved water resistance of the endcap 300 and/or the housing 200, such as when included in a water-resistant installation of the housing 200.

In some implementations, the endcap 300 may include one or more additional receptive points that can receive additional components of the housing 200, or another component of an emergency lighting system. For example, a vent point 315 may receive a vent plug, such as a vent plug to release gasses (e.g., battery outgassing, heated air) from within the housing 200. The vent plug may be sealed or otherwise rated to resist water incursion. In addition, one or more of the vent point 315 or the connection point 310 (or an additional receptive point of the endcap 300) may receive a test switch, a pilot light, or another component of an emergency lighting system. The test switch, pilot light, or other component may be sealed or otherwise rated to resist water incursion. In some cases, an emergency lighting component housing may be fitted with multiple endcaps that respectively have particular receptive points to receive particular components of the emergency lighting system. For example, the emergency lighting component housing may be fitted at a first opening with a first endcap that has a connection point to receive a conduit, such as described in regards to connection point 310. In addition, the emergency lighting component housing may be fitted at a second opening with a second endcap that has one or more of a vent point, a receptive point for a test switch, or a receptive point for a pilot light.

Figure 4:
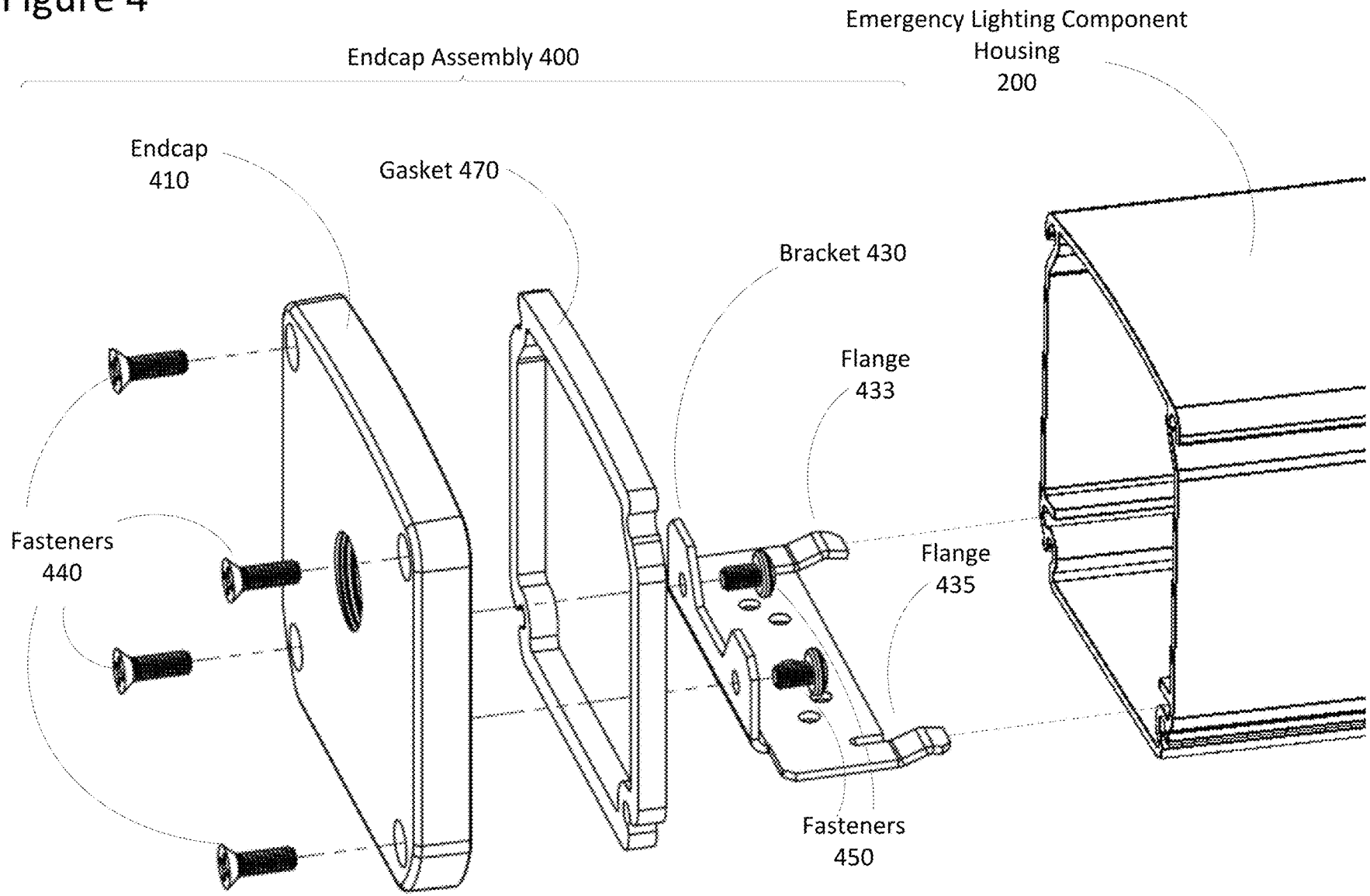
FIG. 4 is an exploded view of an example endcap assembly that is shown in relation to a housing of an emergency lighting component, according to certain implementations.

FIG. 4 is an exploded view of an example endcap assembly 400. For convenience, and not by way of limitation, the endcap assembly 400 is shown in relation to the example housing 200 described in regards to FIG. 2, but other configurations are possible. In some cases, the endcap assembly 400 may be attached to the housing 200, such as to seal or otherwise resist water incursion the internal cavity 250.

In some implementations, the endcap assembly 400 includes one or more of an endcap 400, a gasket 470, and a mounting bracket 430. In some cases, the endcap 410 may include one or more fastener points, connection points, water-resistant features, or receptive points, such as described in regards to the endcap 300 in FIG. 3. In addition, the endcap 410 may have an orientation that is configured to match the water-resistant orientation of the housing 200, such as described in regards to the endcap 300. The endcap 410 may have one or more fastener points (such as the fastener points 302, 304, 306, or 308) that are configured to receive a respective one of fasteners 440. In FIG. 4, the fasteners 440 are depicted as screws, but other types of fasteners are possible, such as nails, clamps, clips, snaps, or any other suitable type of fastener.

In some implementations, the endcap 410 may have one or more of a perimeter rim or an interior rim (such as the perimeter rim 320 or the interior rim 325). In addition, the gasket 470 may fit in a channel formed by the perimeter and interior rims of the endcap 410. The gasket 470 may include one or more curvatures that are configured to respectively fit around a fastener, such as the fasteners 440. For example, the gasket 470 may include corners having curvatures, such that, when fitted into the channel of the endcap 410, one or more of the fasteners 440 extends through the gasket 470 via the curvatures. In some cases, the gasket 470 may have a width that is less than a length of the fasteners 440, such that when the endcap 410 is attached to the housing 200 (e.g., in a water-resistant installation), the fasteners 400 may extend through the gasket 470 and into additional fastener points of the housing 200. The additional fastener points of the housing may include a concave opening formed by a material of the housing. For example, the fasteners 400 may extend into a respective one of the concave openings 215 or 225 on a left or right side of the housing 200. In some cases, the concave opening of the housing 200 may be threaded or otherwise arranged to attach to a fastener.

In addition, the gasket 470 may provide a water-resistant seal for one or more of the endcap assembly 400 or the housing 200. For example, in a water-resistant installation of the housing 200, the gasket 470 may provide a water-resistant seal between overlapping areas of the perimeter and interior rims of the endcap 410 with the outer and inner surfaces of the housing 200. In addition, the gasket 470 may provide a water-resistant seal that prevents or reduces water incursion into the internal cavity 250.

In the endcap assembly 400, the mounting bracket 430 may attach to the endcap 410. For example, a fastener of the bracket 430, such as one or more of the fasteners 450, may attach to respective bracket fastener points on the endcap 410 (such as the fastener points 301 or 303). In FIG. 4, the bracket fasteners 450 are depicted as screws, but other types of fasteners are possible. In addition, the bracket 430 may be configured to attach to an emergency lighting component that can be housed within the internal cavity 250 of the housing 200. For example, the bracket 430 may include one or more additional fastener points via which a fastener of the emergency lighting component is mounted on the bracket 430.

In some implementations, the bracket 430 may have one or more flanges, such as a flange 433 and a flange 435. The flanges 433 and 435 may each be arranged at or near a respective edge of the bracket 430. In addition, the flanges 433 and 435 may be arranged to align with one or more concave openings on the interior of the housing 200, such as in a water-resistant installation. For example, the flanges 433 and 435 may have a horizontal spacing or a vertical spacing that aligns the flange 435 with the concave opening 255, and the flange 433 with an additional concave opening of the housing 200 (e.g., on an opposite side of the housing 200 or otherwise spaced away from the concave opening 255). The flanges 433 and 435 may be arranged to fit into respective rail channels defined by one or more respective mounting rails of the housing 200. For example, the flange 435 may fit into a rail channel defined by the concave opening 255 between the rails 251 and 253. In addition, the flange 433 may fit into an additional rail channel defined by an additional concave opening between additional rails of the housing 200. In FIG. 4, the flanges 433 and 435 are depicted as having a spring-type configuration, but other configurations are possible, such as a smooth or non-spring flange. In some cases, a flange having a spring-type configuration can provide a tight fit between the flange and the rail channel, and may improve a water-resistant installation by improving a fit between the housing 200 and endcap assembly 400.

In some cases, the flanges 433 and 435 are arranged such that the emergency lighting component mounted on the bracket 430 is located between the flange 433 and 435. For example, the emergency lighting component may be supported by the bracket 430, the flange 433, and the flange 435 at a position within the internal cavity 250. In some cases, the bracket 430 and the flanges 433 and 435 may be arranged to support the emergency lighting component at a position that is suspended above a ventral surface of the housing 200, such that the emergency lighting component is suspended above an amount of water that may intrude in the internal cavity 250.

In some cases, an additional mounting bracket or one or more additional flanges may be attached to an additional end of the emergency lighting component (e.g., at an end opposite the endcap 410). The additional flanges may be aligned with the concave openings of the housing 200. For example, the additional flanges may fit between respective rails of the housing 200 and slide to an additional portion of the housing 200 (e.g., at an end opposite the endcap 410). The additional flanges may support the emergency lighting component at the position within the internal cavity 250, such as by supporting an opposite end of the emergency lighting component.

Figure 5A:
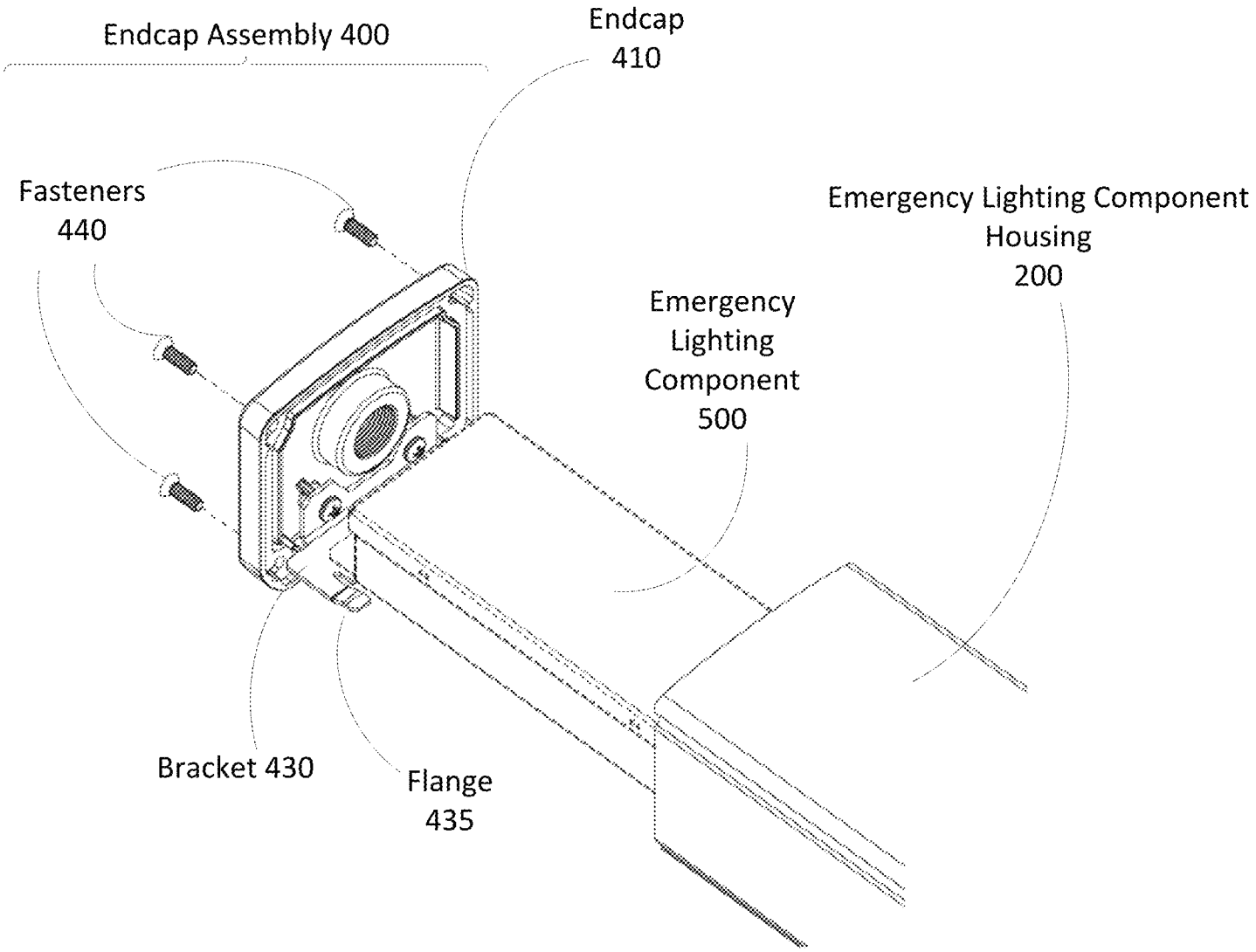
FIGS. 5A and 5B (collectively referred to as FIG. 5) are views of an example emergency lighting component placement with regards to an endcap and a housing, according to certain implementations.
Figure 5B:
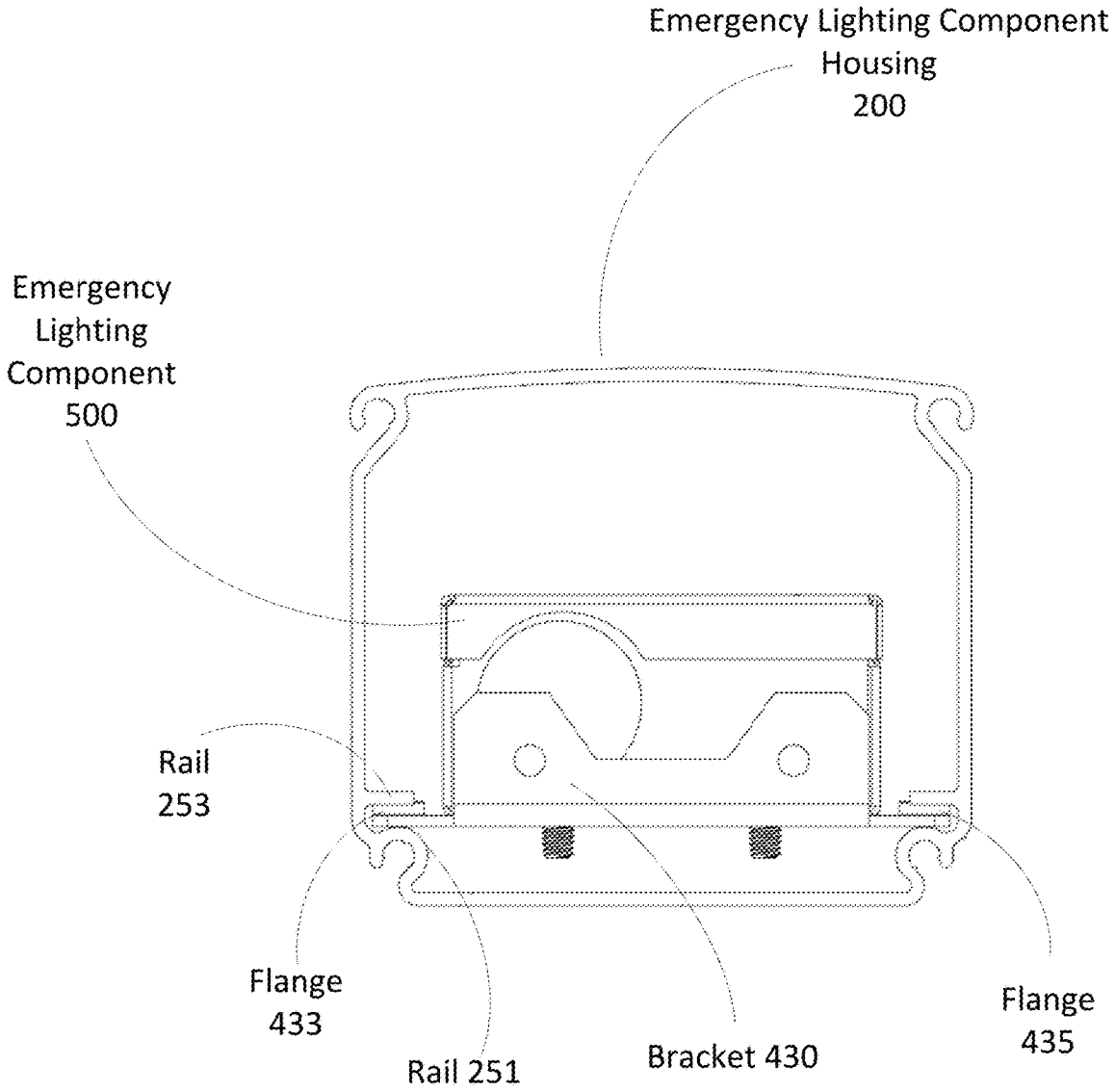

In some implementations, an emergency lighting component may be attached to an endcap assembly for placement within a housing. FIG. 5A is an isometric exploded view of an example emergency lighting component 500 that may attach to the example endcap assembly 400. FIG. 5B is an elevation view of the example emergency lighting component 500 placed within the example emergency lighting component housing 200. FIGS. 5A and 5B may be collectively referred to herein as FIG. 5. For convenience, and not by way of limitation, the emergency lighting component 500 is described with regards to the example housing 200 and the example endcap assembly 400 described in regards to FIGS. 2 and 4, but other configurations are possible.

In FIG. 5A, the emergency lighting component 500 is depicted as being attached to the endcap assembly 400. For example, the component 500 may be attached to the bracket 430 via one or more fasteners. The bracket 430 may be arranged such that one or more flanges of the bracket, such as flanges 433 and 435, may each have a respective position with respect to the component 500. In FIG. 5, the component 500 is depicted as being located between a horizontal arrangement of the flanges 433 and 435, but other configurations are possible, such as vertical arrangement of flanges, or any other arrangement that can hold an emergency lighting component at a particular position with a housing.

In some implementations, the emergency lighting component 500 may be placed within the housing 200. In FIG. 5B, the emergency lighting component 500 is depicted as having a placement within the housing 200. FIG. 5B depicts an elevation view of the emergency lighting component 500 attached to the bracket 430, such that the component 500 is aligned for placement within the housing 200. It is to be understood that the bracket 430, as depicted in FIG. 5B, may be attached to an endcap or endcap assembly of the housing 200, such as the endcap assembly 400 depicted in FIG. 5A.

In some cases, the placement of the component 500 may be facilitated by one or more features of the endcap assembly 400. For example, the bracket 430 may be attached to the endcap 410 (e.g., within the assembly 400) at a particular position with respect to the endcap 410. In addition, the bracket 430 may be attached to the endcap 410 such that one or more of the flanges 433 or 435 are aligned with respective rail channels of the housing 200. In addition, the placement of the component 500 may be facilitated by one or more features of the housing 200. For example, an alignment of the flange 433 between the rails 251 and 253, such as in a rail channel defined by the concave opening 255.

In some cases, one or more of the attachment of the bracket 430 on the endcap 410 or the alignment of the flanges 433 and 435 may place the component 500 in a position within the housing 200. The position can be a water-resistant feature of a water-resistant installation of the housing 200. For example, placing the component 500 at a distance (e.g., about 0.5 cm to about 3 cm) above a base side of the housing 200 may prevent contact between the component 500 and water that might intrude into the housing 200. In addition, features that facilitate placement of the component 500 within the housing 200 may enable easier installation of the component 500 and housing 200, such as easier installation in a water-resistant installation.

General Considerations

Numerous specific details are set forth herein to provide a thorough understanding of the claimed subject matter. However, those skilled in the art will understand that the claimed subject matter may be practiced without these specific details. In other instances, methods, apparatuses, or systems that would be known by one of ordinary skill have not been described in detail so as not to obscure claimed subject matter.

The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Headings, lists, and numbering included herein are for ease of explanation only and are not meant to be limiting.

While the present subject matter has been described in detail with respect to specific implementations thereof, it will be appreciated that those skilled in the art, upon attaining an understanding of the foregoing, may readily produce alterations to, variations of, and equivalents to such implementations. Accordingly, it should be understood that the present disclosure has been presented for purposes of example rather than limitation, and does not preclude inclusion of such modifications, variations, and/or additions to the present subject matter as would be readily apparent to one of ordinary skill in the art.

What is claimed is:

1. An emergency lighting system, comprising:

a housing for an emergency lighting component, the housing including a base side, a curved side opposite the base side, a first side between the base side and the curved side, and a second side between the base side and the curved side opposite the first side, wherein the housing defines an internal cavity configured to receive the emergency lighting component, wherein the first side and the second side each include an outer dorsal surface proximate the curved side and an outer ventral surface proximate the base side, wherein the outer dorsal surface includes (i) an inclined surface that inclines towards the base side and (ii) an extended edge of the inclined surface, wherein the extended edge includes a curve that provides a first concave opening between the extended edge and the inclined surface, wherein the outer ventral surface includes a curve that provides a second concave opening where the outer ventral surface joins the base side; and a first endcap that covers a first end of the housing, wherein the first endcap includes a rim that extends around a perimeter of the first endcap and that fits around a portion of an outer surface of the housing when the first endcap is attached to the first end of the housing, wherein a plurality of fasteners attach the first endcap to the housing, the fasteners received in one or more of the first concave openings in the first side and second side and the second concave openings in the first side and the second side.

2. The emergency lighting system of claim 1, wherein the first and second sides each include a pair of rails extending from an inner ventral surface into the internal cavity of the housing along at least a portion of a length of the housing, wherein a channel is defined by the pair of rails.

3. The emergency lighting system of claim 2, wherein at least one of the pair of rails is formed by a portion of the inner ventral surface that is included in the curve that provides the second concave opening.

4. The emergency lighting system of claim 2, wherein the first endcap further includes a mounting bracket, wherein:

the mounting bracket includes a first flange and a second flange, and the first flange is inserted into the channel defined by the pair of rails included in the first side and the second flange is inserted into the channel defined by the pair of rails included in the second side.

5. The emergency lighting system of claim 1, wherein the first endcap further includes (i) a channel defined between the rim and a second inner rim and (ii) a gasket located between the rim and the second inner rim.

6. The emergency lighting system of claim 1, wherein the emergency lighting system has a water-resistant orientation, such that, in an installation of the emergency lighting system according to the water-resistant orientation:

the curved side is located above the base side, the first concave opening and the second concave opening each opens in a direction away from the curved side, and the internal cavity is enclosed by, at least, the first endcap that covers the first opening of the housing.

7. The emergency lighting system of claim 1, further comprising:

a conduit that receives one or more electrical conductors, wherein the one or more electrical conductors are configured to provide an electrical connection between the emergency lighting component and a luminaire, the first endcap further including a connection point to which the conduit attaches, wherein the one or more electrical conductors are received by the conduit via the connection point.

8. The emergency lighting system of claim 1, further comprising a luminaire that is electrically connected to the emergency lighting component, wherein one or more of the first concave opening or the second concave opening is an extended concave opening that extends along a length of the housing, and wherein the extended concave opening is configured to receive external mounting hardware that secures the housing at a position with respect to the luminaire.

9. The emergency lighting system of claim 1, wherein the emergency lighting component includes one or more of: an emergency lighting driver, or an emergency lighting power supply.

10. The emergency lighting system of claim 1, further comprising a second endcap that covers a second end of the housing, wherein the second endcap includes an additional rim that extends around a perimeter of the second endcap and that fits around an additional portion of the outer surface of the housing when the second endcap is attached to the second end of the housing, wherein an additional plurality of fasteners attach the second endcap to the housing, the additional fasteners received in one or more of the first concave openings in the first side and second side and the second concave openings in the first side and the second side.

11. An emergency lighting system, comprising:

a housing for an emergency lighting component, the housing including a dorsal side, a ventral side, and at least one vertical side extending between the dorsal side and the ventral side, wherein the housing defines an internal cavity configured to receive the emergency lighting component, wherein:

an inclined surface of the dorsal side transitions to a first extended edge of the at least one vertical side, wherein the first extended edge includes a curve that provides a first concave opening between the first extended edge and the inclined surface, a recessed edge of the ventral side transitions to a second extended edge of the at least one vertical side, wherein the second extended edge includes a curve that provides a second concave opening between the second extended edge and the recessed edge;

a first endcap that covers a first end of the housing, wherein a plurality of fasteners attach the first endcap to the housing, the fasteners received in one or more of the first concave opening or the second concave opening; and a conduit including one or more electrical conductors providing an electrical connection between the emergency lighting component and a luminaire, wherein the conduit attaches to a connection point of the first endcap.

12. The emergency lighting system of claim 11, wherein the at least one vertical side includes a pair of rails extending from an inner ventral surface into the internal cavity of the housing along at least a portion of a length of the housing, wherein a channel is defined by the pair of rails.

13. The emergency lighting system of claim 12, wherein at least one of the pair of rails is formed by a portion of the inner ventral surface that is included in the curve that provides the second concave opening.

14. The emergency lighting system of claim 12, wherein the first endcap further includes a mounting bracket, wherein:

the mounting bracket includes a first flange and a second flange, and the first flange is inserted into the channel defined by the pair of rails included in the at least one vertical side and the second flange is inserted into an additional channel defined by an additional pair of rails included in an additional vertical side.

15. The emergency lighting system of claim 11, wherein the first endcap further includes (i) a channel defined between a perimeter rim of the first endcap and an interior rim of the first endcap and (ii) a gasket located between the perimeter rim and the interior rim.

16. The emergency lighting system of claim 11, wherein the emergency lighting system has a water-resistant orientation, such that, in an installation of the emergency lighting system according to the water-resistant orientation:

the dorsal side is located above the ventral side, the first concave opening and the second concave opening each opens in a direction away from the dorsal side, and the internal cavity is enclosed by, at least, the first endcap that covers the first opening of the housing.

17. The emergency lighting system of claim 11, wherein one or more of the first concave opening or the second concave opening is an extended concave opening that extends along a length of the housing, and wherein the extended concave opening is configured to receive external mounting hardware that secures the housing at a position with respect to the luminaire.

18. The emergency lighting system of claim 11, wherein the emergency lighting component includes one or more of: an emergency lighting driver, or an emergency lighting power supply.

19. The emergency lighting system of claim 11, further comprising a second endcap that covers a second end of the housing, wherein an additional plurality of fasteners attach the second endcap to the housing, the additional fasteners received in one or more of the first concave opening or the second concave opening.

20. The emergency lighting system of claim 19, further comprising a test switch, wherein the test switch is attached at an additional connection point of the second endcap.

* * * * *